United States Patent [19]

Mustacchi

[11] 4,055,425

[45] Oct. 25, 1977

[54] DIAZOTYPE MATERIAL AND GRAPHIC REPRODUCTION PROCESSES EMPLOYING THE SAME

[75] Inventor: Henry Mustacchi, London, England

[73] Assignee: GAF Corporation, New York, N.Y.

[21] Appl. No.: 556,971

[22] Filed: Mar. 10, 1975

[51] Int. Cl.[2] ..... G03C 1/58

[52] U.S. Cl. ..... 96/49; 8/41 R; 96/91 R

[58] Field of Search ..... 96/91 R, 49; 8/41 R

[56] References Cited

U.S. PATENT DOCUMENTS

| | | | |
|---|---|---|---|
| 2,618,555 | 11/1952 | Reichel | 96/91 R |
| 2,995,465 | 8/1961 | Richey | 428/511 |
| 2,995,466 | 8/1961 | Sorensen | 8/41 R |
| 3,463,638 | 8/1969 | Damm | 96/49 |
| 3,910,794 | 10/1975 | Buisine et al. | 96/91 R |

FOREIGN PATENT DOCUMENTS

| | | |
|---|---|---|
| 1,247,860 | 8/1967 | Germany |

*Primary Examiner*—Thomas J. Herbert, Jr.
*Attorney, Agent, or Firm*—W. C. Kehm; E. G. Comrie

[57] ABSTRACT

A diazotype material, which comprises a supported light-sensitive layer comprising a light-sensitive, water-insoluble diazoimino compound of the formula:

wherein R is an aryl group and $R_1$ and $R_2$ are organic radicals, which may be the same or different, or $R_1$ and $R_2$ together with the nitrogen atom to which they are attached form a heterocyclic group, an azo coupler, and an alkaline material, said diazoimino compound, when exposed to ultraviolet light, being reactive with said azo coupler to form a visible dye product only at a pH greater than 7. The diazotype material can be used for diazotype reproduction processes resulting in negative or direct positive images.

38 Claims, 9 Drawing Figures

DIAZOTYPE MATERIAL AND GRAPHIC REPRODUCTION PROCESSES EMPLOYING THE SAME

The present invention relates to diazotype materials, and in particular to diazotype materials containing an ultra-violet light-sensitive composition comprising a diazoimino compound.

Diazotype materials are in extensive use, and rely on the reaction between a diazonium compound and an azo coupler to form, after exposure and development, a visible azoic dye in imagewise exposed areas (negative working) or imagewise nonexposed areas (positive working). It has now been discovered that certain light-sensitive, water-insoluble diazoimino compounds can be used in the light-sensitive composition of the diazotype material to provide a diazotype material that is negative or positive working, has good shelf-like and is more versatile than conventional diazotype or vessicular processes.

It is thus an object of the present invention to provide an improved diazotype material.

It is another object of the invention to provide a diazotype material that is storage-stable and that can be used to produce storage-stable images of good image contrast.

The present invention achieves these objects by providing a light-sensitive diazotype composition comprising a light-sensitive, water-insoluble diazoimino compound of the formula:

$$R-N=N-\underset{\underset{R_2}{|}}{N}-R_1 \qquad (I)$$

wherein R is an aryl group and $R_1$ and $R_2$ are organic radicals, which may be the same or different, or $R_1$ and $R_2$ together with the nitrogen atom to which they are attached form a heterocyclic group, an azo coupler, and an alkaline substance, said diazoimino compound, when exposed to ultraviolet light, being reactive with said azo coupler to form a visible dye product only at a pH greater than 7.

The present invention also provides a process for forming a light-stable positive or negative image by imagewise exposure with ultraviolet light of a diazotype material containing the light-sensitive diazotype composition of the present invention, including a fixing process that eliminates all light-sensitive material from the final negative or positive copy.

The present invention is based on the discovery tht the light-sensitive diazoimino compounds of formula (I) react with the azo coupler in the presence of the alkaline material to form an immediately visible negative image when these compounds are subject to imagewise exposure with ultraviolet light. The present invention also relies on the known property of diazoimino compounds to convert easily, under the influence of acids, to diazonium compounds, whereby a negative image may be fixed by a fixing process including acid treatment.

The present invention is illustrated by the accompanying drawing, in which:

FIGS. 1*a*–1*e* are a schematic illustration of the process of the inventin for preparing a negative diazotype copy of an original; and FIGS. 2*a*–2*d* are a schematic illustration of the process of the invention for preparing a positive diazotype copy of an original.

Figures 1A, 1B, 1C, 1D, 1E:
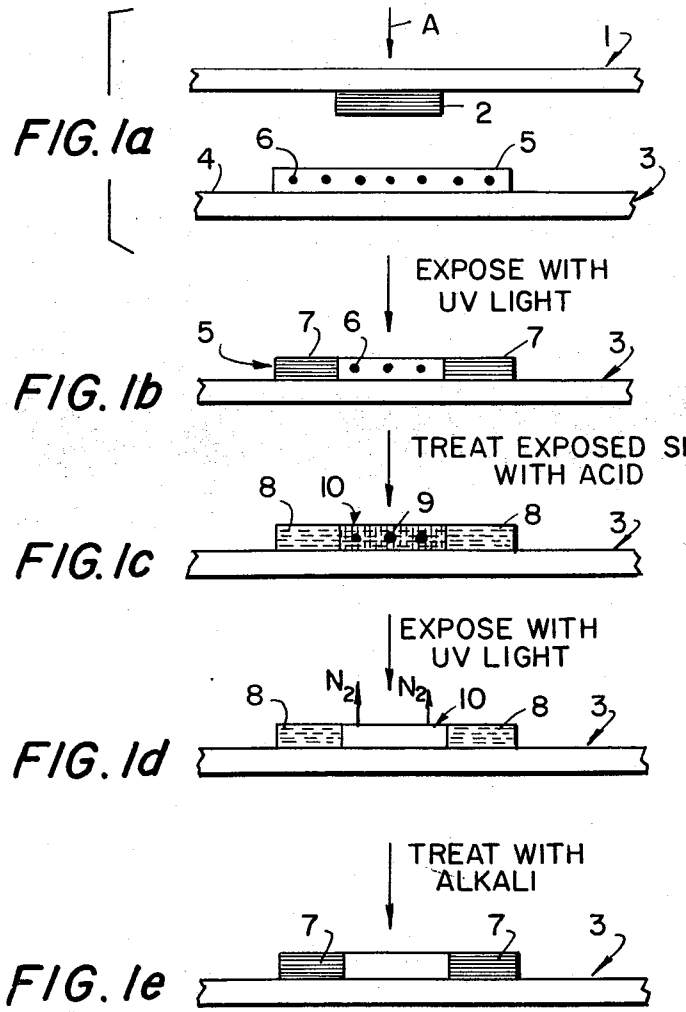

With reference to FIGS. 1*a*–1*e*, an original 1 to be copied, which has opaque information 2 thereon, is placed against diazotype material 3 which comprises a support 4 made of suitable transparent or translucent material, to be described in detail later on, and a light-sensitive layer 5 comprising a diazoimino compound 6, an azo coupler (not shown) and an alkaline material (not shown). The original 1 and diazotype material 3 are exposed to ultraviolet light in the direction of arrow A and, as shown in FIG. 1*b*, the light-sensitive layer 5 undergoes a change due to the instantaneous formation of azo dye 7 in areas where ultraviolet light has passed through the original 1, but the portion of the layer 5 which has been protected by the graphic image 2 remains unchanged and the diazoimino compound 6 is still present in the unexposed area. When the azo dye 7 is of high visibility, a contrasting negative image of the original is obtained. Since the diazoimino compound 6 that is present in the unexposed areas is still light-sensitive, it is necessary to modify the diazoimino compound so that it is no longer light-sensitive. It is well known that diazoimino compounds, under the influence of acids, revert to diazonium ions and amines which react with the acids to form a salt. Consequently, the second step of the reproduction process is to treat the exposed sheet 3 with an acid, either a gaseous organic or inorganic acid, such as formic and acetic acid or HCl, or a liquid inorganic or organic acid, such as dilute solutions of inorganic or organic acids. The result of the acid treatment is shown in FIG. 1*c*, wherein the azo dye 7 has been altered by the acid to forman azo dye 8 of lighter shade and whereby the diazoimino compound 6 has been converted to a yellow diazonium compound 9. Since the diazonium comound 9 is chosen so that it does not react with the azo coupler in an acid media, no azo dye is formed in the area 10 wherein the diazonium compound 9 is distributed.

After the treatment with acid, the sheet 3 is exposed again to ultraviolet light and the resulting product is shown in FIG. 1*d*. Under the action of ultraviolet light, the diazonium compound 9 breaks down and releases nitrogen gas and forms a colorless, stable non-reactive phenolic decomposition product. Hence, the area 10 is now colorless and the image formed by azo dye 8 is fixed.

Generally, the treatment of sheet 3 with acid will alter the azo dye shade in accordance with whatever effect pH has on the azo dye. In order to restore the full density of the azo dye, which is generally brighter in an alkaline or neutral media than in an acid media, the sheet 3 is subjected to an alkaline treatment by contacting the surface with ammonia gas or other gaseous alkaline material or with a liquid alkaline material, and the final product is shown in FIG. 1*e* as comprising a negative image of sharp contrast formed by the azo dye 10. Since the treatment with alkali is simply to restore the full density of the azo dye, any alkaline material can be used for such treatment, such as is conventionally used in diazo reproduction processes.

FIGS. 2*a*–2*d* illustrate the case where a positive image is obtained.

The first step in the direct positive working process is to treat the copy sheet 3 with acid, such as the acid fumes or liquid acid solution described above, to neutralize the alkali in layer 5 and convert the diazoimino compound 6 to the diazonium compound 9. After the treatment with acid, the modified copy sheet 3', shown in FIG. 2*b*, has the diazonium compound 9 dispersed throughout the yellow-colored layer 5. Since the pH in layer 5 is below 7, as a result of the acid treatment, the diazonium compound 9 and the azo coupler do not interact to form an azo dye.

Figures 2A, 2B, 2C, 2D:
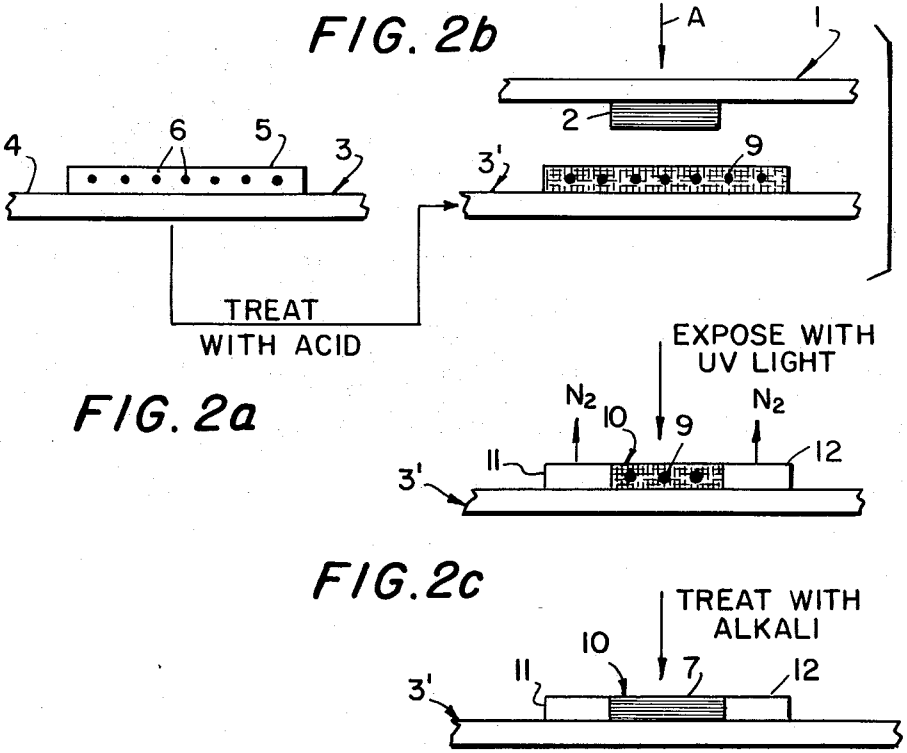

The second step is to expose the copy sheet 3' with ultraviolet light in the direction A through the original 1. The exposure to ultraviolet light causes the diazonium compound 9 to decompose into the colorless phenolic compound, as described above, together with the evolution of nitrogen gas in those areas 11 and 12 corresponding to exposure by the ultraviolet light. The central area 10, which was under the image area 2, remains unchanged and has the diazonium compound 9 dispersed throughout, as shown in FIG. 2*c*. To fully develop and fix the latent positive image, the copy sheet 3' is treated with alkali and the final product is shown in FIG. 2*d* as having a stable azo dye 7 in the positive image area 10 and colorless areas 11 and 12. The treatment of copy sheet 3' with alkali causes the diazonium compound 9 and the azo coupler to interact to form the stable azo dye. Accordingly, any alkaline treatment, such as described above, may be employed.

It can thus be seen that, depending on the pretreatment of the copy sheet 3, a negative or a direct positive image can be obtained. The unique action and versatility of the light-sensitive composition employed in the diazo-type material of the invention is entirely due to the use of the diazoimino compound.

Diazoimino compounds, and their distinction from diazoamino compounds, i.e. R—N=N—NHR, are described in "Azo and Diazo Chemistry, Aliphatic and Aromatic Compounds", H. Zollinger, Interscience Publishers, 1961, page 177. Useful diazoimino compounds for the present invention have the formula I and are highly water-insoluble, but organic solvent-soluble, are light-sensitive, and must not be reactive with the azo coupler in the presence of acid, to form an azo dye. In addition, the diazoimino compound and the azo coupler, in the presence of an alkali and in the total absence of light, must not be reactive to form an azo dye.

For the purpose of explanation, a diazoimino compound is considered as light-sensitive when a composition containing the diazoimino compound, an azo coupler and an alkaline material is exposed through a translucent original to an ultraviolet mercury vapor lamp, rated at 80-watts per linear inch, and a visible image is formed in less than 5 minutes exposure. Highly light-sensitive compounds form a dense image in only 1 to 3 seconds, whereas weakly light-sensitive compounds form a weak image after an exposure of more than 1 minute. If no visible image is formed after 5 minutes, the compound is not light-sensitive.

Several proposals have been made in the art for the use of light-stable triazenes in thermographic copy sheets, wherein heat is used to decompose the triazene and a visible image is formed by reaction between the heat-decomposition products and an azo coupler, such as the proposals in U.S. Pat. Nos. 2,995,465 and 2,995,466. Light-stable diazoamino compounds have also been proposed for use as a dyestuff intermediate in color printing of textile intermediates. In U.S. Pat. No. 2,618,555, there is a proposal to form a negative image-wise distribution of a light-stable triazene by in situ reaction within a diazotype material. None of these proposals, however, deal with light-sensitive diazoimino compounds.

British Pat. No. 1,147,896 proposes the use of a light-sensitive diazoamino compound of the formula R—N=N—NH—R, wherein R is hydrogen, aryl or phenyl, in a diazotype composition that also contains an alkaline stabilizing agent, an alkali metal salt that is heat-decomposable to form hydroxyl ions and an azo coupler. Upon exposure to ultraviolet light, the diazoamino compound decomposes to form a diazonium compound, which in turn reacts with the azo coupler to form a dye product. The image is fixed by heating to decompose the alkali and thus render the unexposed areas passive. However, the heating will also decompose the diazoamino compound in the unexposed areas to form a diazonium compound that is available for coupling with the azo coupler to form a dye product, hence reducing image contrast during storage or the like. This cannot happen in the present invention, since the exposed diazotype material is fixed in accordance with the present invention by converting all of the unexposed diazoimino into a diazonium compound, which is subsequently converted by ultraviolet exposure to a colorless non-reactive phenolic compound.

Further, the proposal of British Pat. No. 1,147,896 requires the use of diazoic compositions of fixed proportions of diazoamino compound, couplers and stabilizers. No such limitation exists in the present invention where the ratios of components can be chosen for optimum results, Indeed, it is a particular advantage of the present invention that because of the flexibility in the choice of proportions of the various fundamental ingredients, diazotype compositions can be made with very extended shelf-life.

Diazoimino compounds that are useful in the present invention have the general formula (I) and the characteristics described above. In a preferred embodiment of the invention, the diazoimino compounds are those of formula (I), wherein R is phenyl or naphthyl, most preferably phenyl, unsubstituted or substituted by one or more if $C_1$ to $C_{18}$ alkyl, halogen, $R_3$—O—, $R_4$—S— or

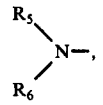

where $R_3$ and $R_4$ are independently aliphatic or aromatic, and $R_5$ and $R_6$ are hydrogen, aliphatic or aromatic, or $R_5$ and $R_6$ together with the nitrogen atom to which they are attached form a saturated or unsaturated heterocyclic group containing the nitrogen atom as the sole heteroatom or containing oxygen, sulfur or a second nitrogen atom as an additional heteroatom; and $R_1$ and $R_2$ are independently alkyl, alkoxy, alkenyl, aralkyl or aryl, said $R_1$ and $R_2$ each having up to 18 carbon atoms; or $R_1$ and $R_2$ together with the nitrogen atom to which they are attached form a saturated or unsaturated heterocyclic group containing the nitrogen atom as the sole heteroatom or containing oxygen, sulfur or a second nitrogen atom as an additional heteroatom.

The diazoimino compounds of formula (I) are readily prepared by condensation of a diazonium compound (II) and an organic amine (III) as shown below:

$$\text{(II) } R\text{-}N{=}N^{+}A^{-} + \text{(III) } R_1R_2NH \rightarrow \text{(I)}$$

where R, $R_1$ and $R_2$ are as defined above, and A is a cation. The diazonium compounds (II) suitable for the preparation of diazoimines of formula (I) must have the property of being sensitive to ultraviolet light and decompose readily under exposure to give substantially colorless products that are non-reactive with an azo coupler. They are preferably diazonium compounds of the benzene and naphthalene series, either unsubstituted or substituted in the nucleus by one or more substituents. The para position to the diazonium group is preferably occupied by $R_3$—O—, or $R_4$—S, or

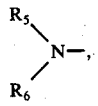

where $R_3$–$R_6$ are as defined above, and the ortho and/or meta positions to the diazonium group may also be substituted separately or simultaneously. All the diazonium compounds used in the well known diazo process are suitable for the preparation of diazoimino compounds of formula (I).

Examples of suitable diazonium compounds (II) that may be used to form diazoimino compounds of formula (I) are compounds a)—v) below:

a. Benzene diazonium compound
b. 3,4-dichloro B.D.C.*
c. 4-Diethylamino B.D.C.
d. 3-Methyl-4-pyrrolidino B.D.C.
e. 3-Methoxy-4-pyrrolidino B.D.C.
f. 3-Chloro-4-N-methyl-cyclohexylamino B.D.C.
g. 3-Chloro-4-hexamethyleneimino B.D.C.
h. 2,5-Diethoxy-4-morpholino B.D.C.
i. 2,5-Diethoxy-4-(p-toluenemercapto) B.D.C.
j. 3-(p-Chlorophenoxy)-4-dimethylamino-6-chloro B.D.C.
k. 3-Methoxy-4-(ethylmercapto)-6-ethoxy-N-methylformamido B.D.C.**
l. 3-Methoxy-4-morpholino-6-(p-toluenemercapto) B.D.C.
m. 4-Dimethylamino B.D.C.
n. 2,5-Dimethoxy-4-(p-toluenemercapto) B.D.C.
o. 3-Chloro-4-morpholino B.D.C.
p. 2-(p-Toluenemercapto)-4-dimethylaminophenyl
q. 3-methoxy-4-(2'-pyridyl-ethylamino) B.D.C.
r. 3-Methoxy-4-(2'-pyridylamino)-6-chloro B.D.C.
s. 2,5-Dimethoxy-4-(p-methylphenoxy) B.D.C.
t. 3-Methoxy-4-(p-chlorophenoxy)-6-(N-pyrrolid-2'-one-yl) B.D.C.
u. 3-(2'-Pyridylamino)-4-(p-toluenemercapto) B.D.C.
v. 2-Methoxy-4-phenoxy B.D.C
w. 4-Morpholino B.D.C.

* B.D.C. = Benzene diazonium compound
** See U.K. Patent No. 1,064,128

Reference is also made to the diazonium compounds disclosed in U.S. Pat. No. 2,501,874 and in Van der Grinten, Photographic Journal, Vol. 92B (1952), page 46.

Suitable amines (III) which are reacted with the diazonium compounds (II) are secondary organic amines, for example diethylamine, dibutylamine, diallylamine, methyl benzylamine, methylcyclohexylamine, hexamethylene imine, piperazine, morpholine, 2,6-dimethylmorpholine, pyrrolidine, piperidine, 2-amino-pyridine, etc.

Examples of diazoimino compounds (I) made by the condensation of a diazonium compound (II) and a secondary organic amine (III), and eminently suitable for use in the present invention are:

1-phenyl-3-morpholino triazene
1-(3,4-dichlorophenyl)-3-pyrrolidino triazene
1-(4-diethylaminophenyl)-3,3-diethyl triazene
1-(4-morpholino-3-chlorophenyl)-3-morpholino triazene
1-(4-tolylmercapto-3-chlorophenyl)-3-hexamethyleneimino triazene
1-(4-p-chlorophenoxy-2,5-diethoxyphenyl)-3-piperidino triazene
1-(4-morpholino-2,5-diethoxyphenyl)-3-methyl-3-cyclohexyl triazene
1-(4-morpholino-2,5-diethoxyphenyl)-3-morpholino triazene
1-(4-pyridylamino-3-methoxy)-3-benzyl-3-methyl triazene
1-(4-pyrrolidino-3-methylphenyl)-3-pyrrolidino triazene
1-(4-morpholino-2,5-diethoxyphenyl)-3,3-diallyl triazene
1-(4-p-methylphenoxy-2,5-dimethoxyphenyl)-3-morpholino triazene
1-(4-morpholino-3-chlorophenyl)-3-morpholino triazene The preparation of diazoimino compounds is well documented in the literature. According to Professor Heinrich Zollinger, author of "Azo and Diazo Chemistry, Aliphatic and Aromatic Compounds", Interscience Publishing Co. (1961), the most important method of preparing diazoimino compounds was described by Griess as early as 1860, wherein an alcoholic solution of aniline is reacted with an amount of nitrous acid fumes insufficient to effect complete diazotization of all the amine to obtain diazoaminobenzene. In "Reaction of Organic Compounds" by W. J. Hickinbottom, Longmans Publishing Co. (1962), the method of preparation of diazoimino compounds is based on the reaction of diazonium salts with amines. This reaction proceeds quite readily with secondary amines, being effected by adding the neutral diazonium salt solution to an aqueous solution of the amine, the temperature being kept at 0° C. In a variation of the method and in the case of amines which are not water-soluble, the condensation may also be effected by adding the diazonium solution to an alcoholic solution of the amine, the temperature being kept at 0° C. A solution of diazonium salt can be used instead of a diazotized arylamine solution. In this case it is preferable not to use diazonium compounds which are stabilized by salts which can be precipitated by alkalis, such as zinc chloride, stannous chloride or cadmium chloride. If such diazonium compounds are used, it would then be necessary, after the reaction with amine, to separate the metal hydroxide and the diazoamino through recrystallization in solvent. Satisfactory diazoimino compounds have been obtained from diazonium compounds stabilized as sulphate or borofluoride salts.

The diazoimino compound (I), the azo coupler and the alkaline material are coated in or on a suitable support in a conventional manner by substituting the diazoimino compound for the diazonium compound in the usual sensitizing balance, and the sensitizing balance is applied to the support directly or to a precoat, where appropriate, by dipping, brushing, spraying or the like. After drying to remove solvent, a firmly adherent layer is obtained, as is well known.

The azo coupler may be any coupler used in the conventional diazo reproduction process for forming an azoic dye by reaction with a diazonium compound at a pH greater than 7. Such couplers may be those containing a phenolic hydroxy group or an active methylene group, and include, but are not limited to, the diazo coupling compounds disclosed at pages 220 to 248 in "Light-Sensitive Systems Chemistry and Application of Non-Silver Halide Photographic Processes"; by Jaromir Kosar, published by John Wiley, New York, Copyright 1965.

The alkaline material serves to maintain the pH of the mixture of diazoimino compound and azo coupler above 7 to prevent premature coupling during storage. The alkaline material may be inorganic or organic, and includes inorganic bases, such as potassium hydroxide, sodium hydroxide or any similar base likely to dissolve at the required concentration in the solvent composition of the systems; organic bases, such as morpholine, pyrrolidine, piperazine, diethylamine, diethanolamine, etc.; and quaternary ammonium bases, such as tetraethylammonium hydroxide, tetramethylammonium hydroxide, etc.

The diazotype material of the invention may employ any desired support for the diazoimino composition, such as paper, linen, a cellulose or cellulose ester film or a plastic film base, such as polyethylene terephthalate, polycarbonate, bisphenol-A-polycarbonate, cellulose acetate, cellulose acetate butyrate, cellulose acetate propionate, polystyrene, polyvinyl chloride and polyvinyl acetate. The most commonly used plastic film base materials are the polyesters and cellulose acetate. A specific polyester which finds widespread use is a heat-set biaxially-oriented linear polyester such as the terephthalic acid/ethylene glycol polyester, sold under the trademarks "Mylar", "Melinex" or "Celanar". it is preferable that the plastic film base support material be transparent or translucent, but it may be opaque for certain applications.

The amounts of the three components of the light-sensitive diazoimino compositions are chosen to give optimum properties, such as high density and contrast, good shelf-life and fast printing speed; the proportions will vary from system to system and for a given system are determined empirically. Generally, however, it will be found that a concentration of diazoimino compound and azo coupler of between about 0.5% and about 3% for each will give suitable printing speed and image density; a concentration of alkali up to about 2% will generally give adequate solution stability and material shelf-life. In addition to the three indispensable components of the light-sensitive diazoimino composition, other non-acidic substances, normally used in conventional diazotype compositions to enhance background or dye shade, can be added, such as thiourea and caffeine.

Exposure, development and fixing of the diazotype material is as described above with reference to the drawings.

The present invention is illustrated by the following Examples. All parts and proportions as referred to herein and in the appended claims are by weight unless otherwise noted.

EXAMPLE 1

A series of diazoimino compounds were prepared by reaction between 4-morpholino-2,5-diethoxyphenyl diazonium borofluoride and a secondary amine. The results are reported in Tables I*a* and I*b* below. The absence of absorption at 2100 $cm^{-1}$ indicates that there was no $=N=N^+$ group, and the band at 1580–1585 $cm^{-1}$ corresponds to the $-N=N-N<$ linkage.

A typical procedure is as follows for the reaction using morpholine as the secondary amine. The other compounds were prepared analogously.

50 grams of 4-morpholino-2,5-diethoxyphenyl diazonium borofluoride were dissolved in 1 liter of water; the solution thus obtained was filtered and then cooled to 0° C.

20 milliliters of morpholine were diluted with iced water to 50 milliliters and then added dropwise to the stirred solution of diazonium compound. The diazoimino compound precipitates. The pH of the solution is found to be between 8 and 9. Stirring is continued for one hour, at the end of which the off-white precipitate is filtered, washed with water and vacuum oven dried at room temperature.

35.0 grams of 1-(4-morpholino-2,5-diethoxyphenyl)-3-morpholino triazene, melting point 137°–139° C were obtained. Recrystallization was not found to be necessary in this case.

TABLE Ia

Diazoimino Compounds of Example 1

| Compound Number | Diazoimino Compound |
|---|---|
| 1 | 1-(4-morpholino-2,5-diethoxyphenyl)-3-morpholino triazine |
| 2 | 1-(4-morpholino-2,5-diethoxyphenyl)-3-piperidino triazene |
| 3 | 1-(4-morpholino-2,5-diethoxyphenyl)-3-pyrrolidino triazene |
| 4 | 1-(4-morpholino-2,5-diethoxyphenyl)-3-piperazino triazene |
| 5 | 1-(4-morpholino-2,5-diethoxyphenyl)-3-hexamethylene imino triazene |
| 6 | 1-(4-morpholino-2,5-diethoxyphenyl)-3,3-dimethyl triazene |
| 7 | 1-(4-morpholino-2,5-diethoxyphenyl)-3,3-diethyl triazene |
| 8 | 1-(4-morpholino-2,5-diethoxyphenyl)-3,3-diallyl triazene |
| 9 | 1-(4-morpholino-2,5-diethoxyphenyl)-3-methyl-3-cyclohexyl triazene |
| 10 | 1-(4-morpholino-2,5-diethoxyphenyl)-3-(2,6-dimethylmorpholino) triazene |

TABLE Ib

Reaction of 4-morpholino-2,5-diethoxyphenyl diazonium, borofluoride and secondary Amine

| DIAZOIMINO COMPOUND Amine | 1 | 2 | 3 | 4 | 5 | 6 | 7 | 8 | 9 | 10 |
|---|---|---|---|---|---|---|---|---|---|---|
| Properties | Morpholine | Piperidine | Pyrrolidine | Piperazine | Hexamethylene imine | Dimethyl amine | Diethyl amine | Diallylamine | N-Methyl Cyclo Hexylamine | 2.6 Dimethyl Morpholine |
| Molecular weight | 364.35 | 362.38 | 348.35 | 363.37 640.59 | 376.4 | 322.32 | 350.37 | 374.39 | 390.43 | 392.35 |
| Melting Point ° C. | 137–139 | 115–117 | 96–98 | 130–132 | 60–62 | 66–68 | 83–85 | 43–44 | 82–84 | 73–75 |
| U.V. spectrum | 360 | 356 | 352 | 358 | 350 | 348 | 350 | 354 | 350 | 358 |

TABLE Ib-continued

| DIAZOIMINO COMPOUND Amine | 1 | 2 | 3 | 4 | 5 | 6 | 7 | 8 | 9 | 10 |
|---|---|---|---|---|---|---|---|---|---|---|
| | Reaction of 4-morpholino-2,5-diethoxyphenyl diazonium, borofluoride and secondary Amine | | | | | | | | | |
| Properties | Morpholine | Piperidine | Pyrrolidine | Piperazine | Hexamethylene imine | Dimethyl amine | Diethyl amine | Diallylamine | N-Methyl Cyclo Hexylamine | 2.6 Dimethyl Morpholine |
| λ Max. | 294 | 294 | 292 | 295 | 290 | 292 | 292 | 292 | 292 | 290 |
| ε | 15200 | 15400 | 16400 | 29200 | 15600 | 14600 | 15800 | 16000 | 15900 | 16300 |
| | 9300 | 9300 | 9200 | 7900 | 9500 | 8300 | 9600 | 9400 | 9800 | 9050 |
| I.R. Spectrum —N=N—N< Band at $cm^{-1}$ | 1585 | 1580 | 1580 | 1580 | 1580 | 1585 | 1585 | 1580 | 1580 | 1585 |

EXAMPLE 2

Following the procedure of Example 1, pyrrolidone was reacted with a series of diazonium compounds to produce additional diazoimino compounds. The diazonium compounds were used as the zinc chloride double salt and the products purified by recrystallization. The results are reported in Tables IIa and IIb below.

TABLE IIa

| Compound Number | Diazoimino Compounds of Example 2 Diazoimino Compound |
|---|---|

TABLE IIa-continued

| Compound Number | Diazoimino Compounds of Example 2 Diazoimino Compound |
|---|---|
| | triazine |
| 17 | 1-(2,5-diethoxy-4-p-toluene mercaptophenyl)-3-pyrrolidino triazine |
| 18 | 1-(3-p-chlorophenoxy-4-dimethylaminophenyl)-3-pyrrolidino triazine |
| 19 | 1-(3-methoxy-4-ethylmercapto-6-ethoxy-N-methyl-formamidophenyl)-3-pyrrolidino triazine |
| 20 | 1-[(3-methoxy-4-morpholino-6-(p-toluene-mercapto phenyl)]-3-pyrrolidino triazine |

TABLE IIb

| DIAZOIMINO COMPOUND Diazonium Compound * | 11 | 12 | 13 | 14 | 15 | 16 | 17 | 18 | 19 | 20 |
|---|---|---|---|---|---|---|---|---|---|---|
| | Reaction of Pyrrolidone and Benzene Diazonium Compound | | | | | | | | | |
| Properties | c | d | e | f | g | h | i | j | k | l |
| Molecular Weight | 246.37 | 258.35 | 274.35 | 320.88 | 306.85 | 348.35 | 385.44 | 379.33 | 366.23 | 412.57 |
| Melting Point °C. | 58–60 | 58–60 | 58–60 | 68–70 | 73–75 | 96–98 | 107–109 | 105–107 | 105–107 | 122–124 |
| U.V. Spectrum | 360 | 340 | 348 | 338 | 340 | 352 | 368 | 349 | 346 | 358 |
| U.V. λ Max. | 328 | | 266 | | | 292 | 292 | 315 | 308 | 305 270 |
| ε | 16800 | 16600 | 17200 | 15700 | 16500 | 16400 | 18600 | 16600 | 19000 | 12800 |
| | 14600 | | 9000 | | | 9200 | 12500 | 14200 | 13000 | 15300 16200 |
| I.R. Spectrum —N=N—N< Band at $cm^{-1}$ | 1585 | 1580 | 1580 | 1570–1580 | 1580 | 1580 | 1550 | 1565 1570 | 1570–1580 | 1570 |

*The diazonium compounds are identified in the list of diazonium compounds on pages 11 and 12

11 1-(4-diethylaminophenyl)-3-pyrrolidino triazine
12 1-(3-methyl-4-pyrrolidinophenyl)-3-pyrrolidino triazene
13 1-(3-methoxy-4-pyrrolidinophenyl)-3-pyrrolidino triazene
14 1-(3-chloro-4-N-methylcyclohexaminophenyl)-3-pyrrolidino triazine
15 1-(3-chloro-4-hexamethylene-imino phenyl)-3-pyrrolidino triazine
16 1-(2,5-diethoxy-4-morpholinophenyl)-3-pyrrolidino

EXAMPLE 3

Following the procedure of Example 1, morpholine was reacted with a series of diazonium compounds to form the diazonium compound reported in Table III. The diazonium compounds were used as the zinc chloride double salt and are identified in pages 11–12 above.

TABLE III

| Diazonium Compound | Diazoimino Compound Name | m.p. |
|---|---|---|
| a | 1-phenyl-3-morpholino triazene | 24–26° C |
| b | 1-(3,4-dichlorophenyl)-3-morpholino triazene | 37° C |
| m | 1-(4-dimethylaminophenyl)-3-morpholino triazene | 120–124° C |
| c | 1-(4-diethylaminophenyl)-3-morpholino triazene | 46–47° C |
| e | 1-(3-methoxy-4-pyrrolidinophenyl)-3-morpholino triazene | — |
| d | 1-(3-methyl-4-pyrrolidinophenyl)-3-morpholino triazene | 86° C (soften) |
| f | 1-(3-chloro-4-N-methyl-cyclohexylaminophenyl)-3-morpholino triazene | 55–56° C (soften) |
| g | 1-(3-chloro-4-hexamethyleneiminophenyl)-3-morpholino triazene | 65° C (soften) 180° C |
| j | 1-(3-p-chlorophenoxy-4-dimethylamino-6-chlorophenyl)-3-morpholino triazene | 104° C (soften) |

TABLE III-continued

| Diazonium Compound | Diazoimino Compound Name | m.p. |
|---|---|---|
| k | 1-(3-methoxy-4-ethylmercapto-6-ethoxy-N-methyl formamidophenyl)-3-morpholino triazene | 95° C |
| h | 1-(2,5-diethoxy-4-morpholinophenyl)-3-morpholino triazene | 138-140° C |
| l | 1-(3-methoxy-4-morpholino-6-p-toluenemercaptophenyl)-3-morpholino triazene | 138-140° C |
| o | 1-(3-chloro-4-morpholinophenyl)-3-morpholino triazene | 127° C (soften) |
| p | 1-(2-p-toluenemercapto-4-dimethylaminophenyl)-3-morpholino triazene | 110-116° C (soften) |
| q | 1-[3-methoxy-4-(2'-pyridyl-ethylamino)phenyl]-3-morpholino triazene | 58-64° C (soften) |
| r | 1-[3-methoxy-4-(2'-pyridylamino)-6-chlorophenyl]-3-morpholino triazene | 129-130° C (soften) |
| s | 1-(2,5-dimethoxy-4-p-methylphenoxyphenyl)-3-morpholino triazene | 109-110° C (soften) |
| t | 1-[3-methoxy-4-p-chlorophenoxy-6-(N-pyrrolid-2'-one-yl)phenyl]-morpholino triazene | 140° C (soften) |
| u | 1-[3-(2'-pyridylamino)-4-p-toluenemercaptophenyl]-morpholino triazene | 240° C (soften) |
| v | 1-(2-methoxy-4-phenoxyphenyl)-morpholino triazene | 180-190° C (soften) |

EXAMPLE 4

Following the procedure of Example 1, other diazoimino compounds are prepared by reaction between the appropriate diazonium compound and secondary amine, using the diazonium compound in the form of the zinc chloride double salt. The results are reported in Table IV.

TABLE IV

| Diazonium* Compound | Amine | Diazoimino Compound Name | m.p. |
|---|---|---|---|
| 1 | piperidine | 1-(3-methoxy-4-morpholino-6-p-toluenemercapto-phenyl)-3-piperidino triazene | 120-124° C |
| 1 | dimethylamine | 1-(3-methoxy-4-morpholino-6-p-toluenemercapto-phenyl)-3,3-dimethyl triazene | 90-92° C |
| 1 | diethylamine | 1-(3-methoxy-4-morpholino-6-p-toluenemercapto-phenyl)-3,3-diethyl triazene | 46-48° C |
| 1 | piperazine | 1-(3-methoxy-4-morpholino-6-p-toluenemercapto-phenyl)-3-piperazino triazene | 66° C (soften) |
| n | diethylamine | 1-(2,5-dimethoxy-4-p-toluenemercaptophenyl)-3,3-diethyl triazene | 60-64° C (soften) |
| w | diallylamine | 1-(4-morpholino-phenyl)-3,3-diallyl triazene | 38-40° C |
| e | diallylamine | 1-(4-pyrrolidino-3-methoxyphenyl)-3,3-diallyl triazene | Oily |

*The diazonium compounds are identified in the list of diazonium compounds on pages 11 and 12

EXAMPLE 5

A thin sheet of transparent polyethylene terephthalate film was coated on one side with the following composition:

| | |
|---|---|
| 1/10 second cellulose acetate butyrate | 12 g |
| Methyl ethyl ketone | 40 cc |
| Ethylene glycol monomethyl ether acetate (Methyl oxitol acetate) | 30 cc |
| Methyl isobutyl ketone | 30 cc |

The thickness of the layer applied is chosen so as to leave 10g/m$^2$ of dried resin on the surface of the film. A separate solution containing the following ingredients id prepared:

| | |
|---|---|
| 1-(4-morpholino-2,5-diethoxyphenyl)-3-morpholino triazene | 3 g |
| N-(3-morpholinopropyl)-3-hydroxy-2-naphthamide | 2 g |
| Morpholine | 1 cc |
| Ethyl alcohol | 30 cc |
| Methyl ethyl ketone | 40 cc |
| Methyl oxitol acette | 30 cc |

The above solution was coated on the cellulose acetate butyrate layer carried by the polyester film by means of a conventional knife coater and dried at a moderate temperature of between 70° C and 90° C. The sheet obtained was colorless and remained unchanged in appearance when kept in the dark at room temperature for a prolonged time.

The coated sheet was exposed through a translucent original having a positive pattern to the light of an ultraviolet lamp rated at 80 watts per linear inch, for a period of 3 to 5 seconds, whereupon a dense negative deep blue image of the original is instantaneously formed. The area of the image which has not been subjected to the light has remained unchanged, and is colorless. The copy thus obtained is placed over a tank containing concentrated hydrochloric acid, the surface of the sheet being exposed to the acid fumes for a period of 10 seconds. When the copy is removed from the tank, the blue image has changed to a red image in the light-exposed areas and the colorless areas have changed to a bright yellow color in the areas non-exposed to the light. The copy is once again exposed to the ultraviolet lamp for a period of 3 to 5 seconds, but this time without any original over it. The areas which were yellow have become colorless and the red image area has remained unchanged. Finally, the copy is exposed to ammonia vapors for 1 second and the image reverts to its original deep blue color. This final print is a true negative copy of the original showing a high contrast between the image areas and the non-image areas and being stable to further exposures to light. Copies obtained in this fashiion are eminently suitable for being viewed in commercial viewers and find applications in microfilm reproductions.

In the example described above, under the action of ultraviolet light, 1-(4-morpholino-2,5-diethoxyphenyl)-3-morpholino triazene decomposes to give rise to the 4-morpholino-2,5-diethoxyphenyl diazonium ion which, in an alkaline media and in the presence of N-(3-morpholinopropyl)-3-hydroxy-2-naphthamide, form the corresponding blue azo dye. Under the action of hydrochloric acid fumes, the undecomposed triazene in the image area is converted to 4-morpholino-2,5-diethoxyphenyl diazonium chloride, and the alkaline media is changed to an acid one, thus preventing the coupling reaction between the diazo and the coupler to take place. When the diazonium chloride formed is exposed to ultraviolet light, it decomposes to the non-reactive 4-morpholino-2,5-diethoxyphenol. Finally, by the action of ammonia on the acid media and a return to an alkaline media, the full brightness of the blue azo dye is reinstated.

EXAMPLE 6

The procedure of Example 5 is followed using a cellulose triacetate film as the support, 1-(4-diethylaminophenyl)-3,3-diethyl triazene as the diazoimino compound and 2,3-dihydroxynaphthalene-6-sulphanilide as the coupler. After processing as in Example 5, a deep blue color negative is obtained.

EXAMPLE 7

A sheet of translucent natural tracing paper is coated, according to conventional methods, with a solvent solution of cellulose acetate, and dried so as to leave 12 g/m² of dried resin on the surface of the paper. A separate solution containing the following ingredients is prepared:

| | |
|---|---|
| 1-(4-pyrrolidino-3-methylphenyl)-3-pyrrolidino triazene | 3 g |
| Ethyl alcohol | 5 cc |
| Methyl ethyl ketone | 20 cc |
| 2-Ethoxyethanol | 75 cc |
| Potassium hydroxide | 1 g |
| Resorcinol | 2 g |

The above solution was coated on the cellulose acetate layer carried by the natural tracing paper by means of a conventional knife coater and dried at a temperature of between 80° C and 100° C. The sheet obtained had a good shelf life when kept in the dark under normal storage conditions.

The sheet was exposed through a translucent original having a negative pattern to the ultraviolet light of a mercury vapor discharge tube in a conventional photoprinting machine for 5 to 7 seconds, whereupon a rich sepia positive image of the original negative pattern is instantaneously formed. The copy thus obtained is dipped in a solution of 20 per cent by weight of monochloroacetic acid for 10 seconds and squeeze-dried. The copy is then once again exposed to the ultraviolet light for a period of 3 to 5 seconds, but this time without any original over it. As the sepia image has not been altered by the action of the acid bath, further development with ammonia vapor is not necessary. Thus a permanent positive sepia copy of the negative original is obtained. In view of the actinic opacity of the sepia image, such a copy is eminently suitable for further reproduction on standard diazotype materials.

EXAMPLE 8

A sheet of transparent polyethylene terephthalate film was coated, as in Example 5, with a layer of cellulose acetate butyrate and subsequently sensitized with the following diazoimino solution:

| | |
|---|---|
| 1-(4-morpholino-2,5-diethoxyphenyl)- | |

-continued

| | |
|---|---|
| 3,3-diallyl triazene | 3 g |
| N-(3-morpholinopropyl)-3-hydroxy-2-naphthamide | 2 g |
| Ethyl alcohol | 10 cc |
| Methylethyl ketone | 30 cc |
| 2-Methoxyethanol acetate | 60 cc |
| Sodium hydroxide | 0.8 g |

The sheet obtained was almost colorless and had a good shelf life when kept in the dark at room temperature.

To obtain a positive image from an original with a positive pattern, the following procedure was followed. The coated sheet was first dipped in a 20 percent aqueous solution of concentrated hydrochloric acid for a period of 5 to 7 seconds, squeeze-dried and allowed to completely dry in a current of air. The sheet had changed after this treatment to a bright yellow color characteristic of diazonium compounds. The sheet was then exposed under a positive original to ultraviolet light, as in Examples 5–7 and for a similar time. The areas struck by light became colorless and the areas protected from the light by the graphic original remained unchanged. The sheet was then exposed to ammonia vapors to produce a true positive bright blue copy of the original.

EXAMPLE 9

The procedure of Example 5 is repeated step by step, with the exception that the sensitizing solution is replaced by the following one:

| | |
|---|---|
| 1-(4-p-methylphenoxy-2,5-dimethoxyphenyl)-3-morpholino triazene | 2.5 g |
| Morpholine | 1 cc |
| Ethyl alcohol | 10 cc |
| Methylethyl ketone | 40 cc |
| 2-Ethoxyethanol | 50 cc |
| 2,3-Dihydroxynaphthalene | 1 g |

The color of the image obtained in this case is bright red.

EXAMPLE 10

A sheet of transparent polyethylene terephthalate film coated with a layer of cellulose acetate propionate is sensitized with the following diazoimino solution:

| | |
|---|---|
| 1-(4-morpholino-3-chlorophenyl)-3-morpholino triazene | 3 g |
| Ethyl alcohol | 5 cc |
| Methylethyl ketone | 45 cc |
| 2-Ethoxyethanol | 50 cc |
| Potassium hydroxide | 0.5 g |

The sheet obtained was exposed through a translucent original having a positive pattern to the ultraviolet light of a 3 kilowatt mercury vapor discharge tube in a conventional photoprinting machine operating at 10 feet per minute, whereupon a strong magenta negative image of the original positive pattern is instantaneously formed. The copy thus obtained is dipped in a solution of 15 percent by weight of trichloroacetic acid for 15 seconds and squeeze-dried. The copy is then once again exposed to the ultraviolet light in a conventional photoprinting machine operating at 10 feet per minute to give a permanent negative image of the original positive pattern.

EXAMPLE 11

A yellow positive or negative image is obtained when in any of Examples 5–10 the coupler used is hydroxyethyl pyrocatechol.

EXAMPLE 12

A sheet of transparent polyethylene terephthalate film was coated as in Example 5, with a layer of cellulose acetate butyrate and subsequently sensitized with the following diazoimino solution:

| | |
|---|---|
| 1-(4-pyrrolidino-3-methoxyphenyl)-3,3-diallyl triazene | 2.5 g |
| Ethyl alcohol | 25 cc |
| Methyl ethyl ketone | 20 cc |
| 2-Ethoxy ethanol | 50 cc |
| Tetraethyl ammonium hydroxide (25% solution in water) | 5 cc |
| N-(3-morpholinopropyl)-3-hydroxy-2-naphthamide | 2 g |
| Thiourea | 1 g |

After processing as in Example 5, a bright dense purple-blue color negative is obtained. The exposure required with this system was shorter than with the system described in Example 5.

EXAMPLE 13

A sheet of 180 g/m² white photographic base paper is initially coated conventionally with a cellulose acetate layer as in Example 7, and subsequently sensitized with the following diazoimino solution:

| | |
|---|---|
| 1-(4-morpholino-2,5-diethoxyphenyl)-3,3-diallyl triazene | 2 g |
| Isopropyl alcohol | 20 cc |
| Methyl ethyl ketone | 25 cc |
| 2-Ethoxyethanol | 55 cc |
| Potassium hydroxide | 1 g |
| N-(3-morpholinopropyl)-3-hydroxy-2-naphthamide | 0.5 g |
| m,m'-ethylenedioxydiphenol | 1.5 g |
| 1-Naphthol-3-sulphonamide | 0.5 g |
| Caffeine | 1 g |

The sheet obtained had good shelf-life when kept in the dark under normal storage conditions.

The sheet was exposed through a silver halide negative obtained by conventional photographic means in amateur or professional photographic cameras, to the ultraviolet light of a mercury vapor discharge tube in a photo-printing machine for 5 to 7 seconds, whereupon a black positive image of the original negative is instantaneously formed. The print thus obtained is exposed to formic acid vapors for 10 seconds and then once again exposed to ultraviolet light for 3 to 5 seconds without any original over it. By warming the print in a current of air at 70° to 80° C for a few second, the retained formic acid vapors are eliminated and the print is thus permanently fixed. A black and white positive image of the original negative, which compares well to a silver halide photograph, is obtained.

Enlargements have also been produced following the same procedure by using instead of a conventional photoprinting machine, an ultraviolet photographic enlarger.

EXAMPLE 14

The procedure of Example 5 is repeated step by step, with the exception that the sensitizing solution is replaced by the following one:

| | |
|---|---|
| 1-(4-morpholinophenyl)-3,3-diallyl triazene | 4 g |
| Ethyl alcohol | 20 cc |
| Methyl ethyl ketone | 20 cc |
| 2-Ethoxyethanol | 60 cc |
| Potassium hydroxide | 1.2 g |
| m,m'-ethylenedioxydiphenol | 3 g |

The color of the image obtained in this case is sepia. The dye formed has a particularly high actinic opacity which makes such a copy eminently suitable for printing on lithographic plates.

What is claimed is:

1. A diazotype material, which comprises a supported light-sensitive layer comprising a light-sensitive, water-insoluble diazoimino compound of the formula reactive $$R-N=N-\underset{\underset{R_2}{|}}{N}-R_1$$

wherein R is an aryl group and $R_1$ and $R_2$ are organic radicals, which may be the same or different, or $R_1$ and $R_2$ together with the nitrogen atom to which they are attached form a 4 to 7 membered heterocyclic group, an azo coupler, and an alkaline material, said diazoimino compound, when exposed to ultraviolet light, being reactive with said azo coupler to form a visible dye product only at a pH greater than 7.

2. A diazotype material according to claim 1, wherein said diazoimino compound is 1-(4-morpholino-2,5-diethoxy-phenyl)-3-morpholino triazene.

3. A diazotype material according to claim 1, wherein said diazomino compound is 1-(4-diethylaminophenyl)-3,3-diethyl triazene.

4. A diazotype material according to claim 1, wherein said diazoimino compound is 1-(4-pyrrolidino-3-methylphenyl)-3-pyrrolidino triazene.

5. A diazotype material according to claim 1, wherein said diazomino compound is 1-(4-morpholino-2,5-diethoxyphenyl)-3,3-diallyl triazene

6. A diazotype material according to claim 1, wherein said diazoimino compound is 1-(4-p-methylphenoxy-2,5-dimethoxyphenyl)-3-morpholino triazene.

7. A diazotype material according to claim 1, wherein said diazoimino compound is 1-(4-morpholino-3-chlorophenyl)-3-morpholino triazene.

8. A diazotype material according to claim 1, wherein said diazoimino compound is 1-(4-pyrrolidino-3-methoxyphenyl)-3,3-diallyl triazene.

9. A diazotype material according to claim 1, wherein said diazoimino compound is 1-(4-morpholinophenyl)-3,3-diallyl triazene.

10. A diazotype material according to claim 1, wherein R is phenyl or naphthyl, unsubstituted or substituted by one or more substituents selected from the group consisting of $C_1$ to $C_{18}$ alkyl, halogen, $R_3$—O—, $R_4$—S— and $$\begin{matrix} R_5 \\ \diagdown \\ N- \\ \diagup \\ R_6 \end{matrix},$$

where $R_3$ and $R_4$ are independently aliphatic or aromatic, and $R_5$ and $R_6$ are hydrogen, aliphatic or aromatic, or $R_5$ and $R_6$ together with the nitrogen atom to which they are attached form a saturated or unsaturated 4 to 7 membered heterocyclic group containing the nitrogen atom as the sole heteroatom or containing oxygen, sulfur or a second nitrogen atom as an additional heteroatom; and $R_1$ and $R_2$ are independently alkyl, alkoxy, alkenyl, aralkyl or aryl, said $R_1$ and $R_2$ each having up to 18 carbon atoms; or $R_1$ and $R_2$ together with the nitrogen atom to which they are attached form a saturated or unsaturated 4 to 7 membered heterocyclic group containing the nitrogen atom as the sole heteroatom or containing oxygen, sulfur or a second nitrogen atom as an additional heteroatom.

11. A diazotype material according to claim 10, wherein R is phenyl, unsubstituted or substituted by one or more of said substituents.

12. A process for diazotype reproduction, which comprises exposing the diazotype material of claim 1 imagewise to ultraviolet light to form a negative image composed of an azoic dye in imagewise exposed areas of said diazotype material, and fixing said negative image by contacting said exposed diazotype material with an acidic material followed by exposure of the diazotype material to ultraviolet light.

13. The process according to claim 12, wherein said diazotype material is contacted with an alkaline material after said fixing.

14. The process according to claim 12, wherein said diazoimino compound is 1-(4-morpholino-2,5-diethoxyphenyl)-3-morpholino triazene.

15. The process according to claim 12, wherein said diazoimino compound is 1-(4-diethylaminophenyl)-3,3-diethyl triazene.

16. The process according to claim 12, wherein said diazoimino compound is 1-(4-pyrrolidino-3-methylphenyl)-3-pyrrolidino triazene.

17. The process according to claim 12, wherein said diazoimino compound is 1-(4-morpholino-2,5-diethoxyphenyl)-3,3-diallyl triazene.

18. The process according to claim 12, wherein said diazoimino compound is 1-(4-p-methylphenoxy-2,5-dimethoxyphenyl)-3-morpholino triazene.

19. The process according to claim 12, wherein said diazoimino compound is 1-(4-morpholino-3-chlorophenyl)-3morpholino triazene.

20. The process according to claim 12, wherein said diazoimino compound is 1-(4-pyrrolidino-3-methoxyphenyl)-3,3-diallyl triazene.

21. The process according to claim 12, wherein said diazoimino compound is 1-(4-morpholinophenyl)-3,3-diallyl triazene.

22. The process according to claim 12, wherein said acidic material is selected from the group consisting of organic and inorganic acids.

23. The process according to claim 22, wherein said acidic material is a liquid or gas.

24. The process according to claim 12, wherein R is phenyl or naphthyl, unsubstituted or substituted by one or more substituents selected from the group consisting of $C_1$ to $C_{18}$ alkyl, halogen, $R_3$-O-, $R_4$-S- and

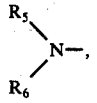

where $R_3$ and $R_4$ are independently aliphatic or aromatic, and $R_5$ and $R_6$ are hydrogen, aliphatic or aromatic, or $R_5$ and $R_6$ together with the nitrogen atom to which they are attached form a saturated or unsaturated 4 to 7 membered heterocyclic group containing the nitrogen atom as the sole heteroatom or containing oxygen, sulfur or a second nitrogen atom as an additional heteroatom; and $R_1$ and $R_2$ are independently alkyl, alkoxy, alkenyl, aralkyl or aryl, said $R_1$ and $R_2$ each having up to 18 carbon atoms; or $R_1$ and $R_2$ together with the nitrogen atom to which they are attached form a saturated or unsaturated 4 to 7 membered heterocyclic group containing the nitrogen atom as the sole heteroatom or containing oxygen, sulfur or a second nitrogen atom as an additional heteroatom.

25. The process according to claim 24, wherein R is phenyl, unsubstituted or substituted by one or more of said substituents.

26. A process for diazotype reproduction, which comprises contacting the diazotype material of claim 1 with an acidic material to lower the pH of said light-sensitive layer to below 7, exposing the thus treated diazotype material imagewise to ultraviolet light to form a latent positive image in imagewise non-exposed areas, and developing said latent image by contacting said diazotype material with an alkaline material.

27. The process according to claim 26, wherein said diazoimino compound is 1-(4-morpholino-2,5-diethoxyphenyl)-3-morpholino triazene.

28. The process according to claim 26, wherein said diazoimino compound is 1-(4-diethylaminophenyl)-3,3-diethyl triazene.

29. The process according to claim 26, wherein said diazomino compound is 1-(4-pyrrolidino-3-methylphenyl)-3-pyrrolidino triazene.

30. The process according to claim 26, wherein said diazoimino compound is 1-(4-morpholino-2,5-diethoxyphenyl)-3,3-diallyl triazene.

31. The process according to claim 26, wherein said diazoimino compound is 1-(4-p-methylphenoxy-2,5-dimethoxyphenyl)-3-morpholino triazene.

32. The process according to claim 26, wherein said diazoimino compound is 1-(4-morpholino-3-chlorophenyl)-3-morpholino triazine.

33. The process according to claim 26, wherein said diazoimino compound is 1-(4-pyrrolidino-3-methoxyphenyl)-3,3-diallyl triazene.

34. The process according to claim 26, wherein said diazoimino compound is 1-(4-morpholinophenyl)-3,3-diallyl triazene.

35. The process according to claim 26, wherein said acidic material is selected from the group consisting of organic and inorganic acids.

36. The process according to claim 35, wheein said acidic material is a liquid or gas.

37. The process according to claim 26, wherein R is phenyl or naphthyl, unsubstituted or substituted by one or more substituents selected from the group consisting of $C_1$ to $C_{18}$ alkyl, halogen, $R_3$—O—, $R_4$—S— and

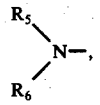

where $R_3$ and $R_4$ are independently aliphatic or aromatic, and $R_5$ and $R_6$ are hydrogen, aliphatic or aromatic, or $R_5$ and $R_6$ together with the nitrogen atom to which they are attached form a saturated or unsaturated 4 to 7 membered heterocyclic group containing the nitrogen atom as the sole heteroatom or containing oxygen, sulfur or a second nitrogen atom as an additional heteroatom; and $R_1$ and $R_2$ are independently alkyl, alkoxy, alkenyl, aralkyl or aryl, said $R_1$ and $R_2$ each having up to 18 carbon atoms; or $R_1$ and $R_2$ together with the nitrogen atom to which they are attached form a saturated or unsaturated 4 to 7 membered heterocyclic group containing the nitrogen atom as the sole heteroatom or containing oxygen, sulfur or a second nitrogen atom as an additional heteroatom.

38. The process according to claim 37 wherein R is phenyl, unsubstituted or substituted by one or more of said substituents.

* * * * *